US005560107A

United States Patent [19]

Herbert

[11] Patent Number: 5,560,107

[45] Date of Patent: Oct. 1, 1996

[54] CUTTING TOOL

[76] Inventor: Paul W. Herbert, 6450 Lakeshore Dr., San Diego, Calif. 92119

[21] Appl. No.: 514,964

[22] Filed: Aug. 14, 1995

[51] Int. Cl.[6] ..... B21F 11/00

[52] U.S. Cl. ..... 30/90.1; 30/254

[58] Field of Search ..... 30/249, 251, 254, 30/271, 90.1, 353, 357, 92

[56] References Cited

U.S. PATENT DOCUMENTS

| | | | |
|---|---|---|---|
| 3,922,783 | 12/1975 | Hayes | 30/250 |
| 4,480,509 | 11/1984 | Hydary | 30/90.1 X |
| 4,502,222 | 3/1985 | Sargent | 30/251 |
| 4,809,433 | 3/1989 | Maxwell et al. | 30/254 |
| 4,980,975 | 1/1991 | Hodson | 30/254 X |
| 5,319,854 | 6/1994 | Pracht | 30/254 |
| 5,414,931 | 5/1995 | Wollermann | 30/90.1 |
| 5,454,165 | 10/1995 | Thompson et al. | 30/249 |

*Primary Examiner*—Hwei-Siu Payer
*Attorney, Agent, or Firm*—Charles C. Logan, II

[57] ABSTRACT

A cutting tool having a pair of cooperating elongated members each having a handle portion and a head portion. The top surface of one of the head portions has a countersunk recess in its bore having a height H1. A brass ring having a thickness T1 is received in the recess. A bolt passes through aligned apertures in the respective head portions and has a nut threaded on its end. Part of the shank of the bolt has a circular cross section and the remainder of the shank has two opposed convex sides and two opposed flat sides and the respective portions of the bolt mate with similarly configured bore holes in the respective head portions.

5 Claims, 2 Drawing Sheets

CUTTING TOOL

BACKGROUND OF THE INVENTION

The invention relates to a tool and more specifically to a cutting tool such as wire cutters, side cutters, shears, etc.

The present cutting tools on the market have a serious problem in that they are difficult to squeeze with a single hand. This is due to the fact that the bolt and nut used to fasten the two handles together are too tight. If they are loosened they are too sloppy. There is no happy median between these two ranges. When the nut is too tight it requires two hands in order to open the cutting surfaces away from each other or to close them back together. If the nut is too loose the respective handle portions have a sloppy uncontrolled looseness.

It is an object of the invention to provide a novel cutting tool that allows the nut connecting the two handles together to be tightened to a degree that allows the handles to be easily manipulated by a single hand.

It is another object of the invention to provide a novel cutting tool in which the head portions each have their rear end configured with a radial concave surface.

It is another object of the invention to provide a novel cutting tool that has the heads or top surfaces of the bolts and nuts beveled to eliminate surfaces that can snag when the tool is removed from a pocket, pouch or belt.

It is an additional object of the invention to provide a novel cutting tool that has the handles configured with convex outer surfaces that mate with a person's hand so that immediate pressure or force is applied sooner to the cutting edges enabling a quicker more precise and cleaner cut.

It is a further object of the invention to provide a cutting tool having handle portions with curved tips at their rear ends for preventing the handles form slipping out of the palm of a person's hand.

SUMMARY OF THE INVENTION

The novel cutting tool has been designed with structure to allow the bolt that tightens the two head portions together to be tightened sufficiently to eliminate loose or sloppiness yet allowing a person to open and close the handle easily using only one hand. This result is accomplished by forming a countersunk recess in the top surface of one of the head portions and it has a height H1. A brass washer is inserted into this recess and it has a thickness T1. The brass washer has a resiliency to allow it to be slightly compressed while maintaining a low coefficient of friction with its contact surface on the head of the bolt it engages.

The bore hole in the head portion that has the countersunk recess also has a bore hole whose configuration is circular. The other head portion has a bore hole whose configuration has two opposed concave surfaces and two opposed flat surfaces. The shank of the bolt that is inserted in the respective aligned bore holes of the respective head portions has a length L1. Part of that shank has a length L2 and its cross sectional surface is round to mate with the bore hole in the head portion that has the countersunk recess. The remainder of the shank has a length L3 and it has a cross section having two opposed convex surfaces and two opposed flat surfaces that mate with the respective bore hole in the head portion having the countersunk recess.

The rear end of the respective head portions also have a radial curvature having a radius R1. This eliminates any right hand angles when the two rear surfaces meet each other internally as the handles are squeezed together. They do not meet at right angles and the two sides come together on a radius rather than at right angles.

The handle portions of the cutting tool have a convex outer curvature that allows hand pressure or force to be applied sooner to the cutting edges enabling a quicker, more precise clean cut. Curved tips on the bottom ends of the handles prevent them from slipping out of the palm of a person's hand.

The top surfaces of the bolt and nut have beveled surface areas. These eliminate the problem of the tool catching or snagging as it is removed from a pocket, pouch or belt.

DESCRIPTION OF THE PREFERRED EMBODIMENT

Figure 1:
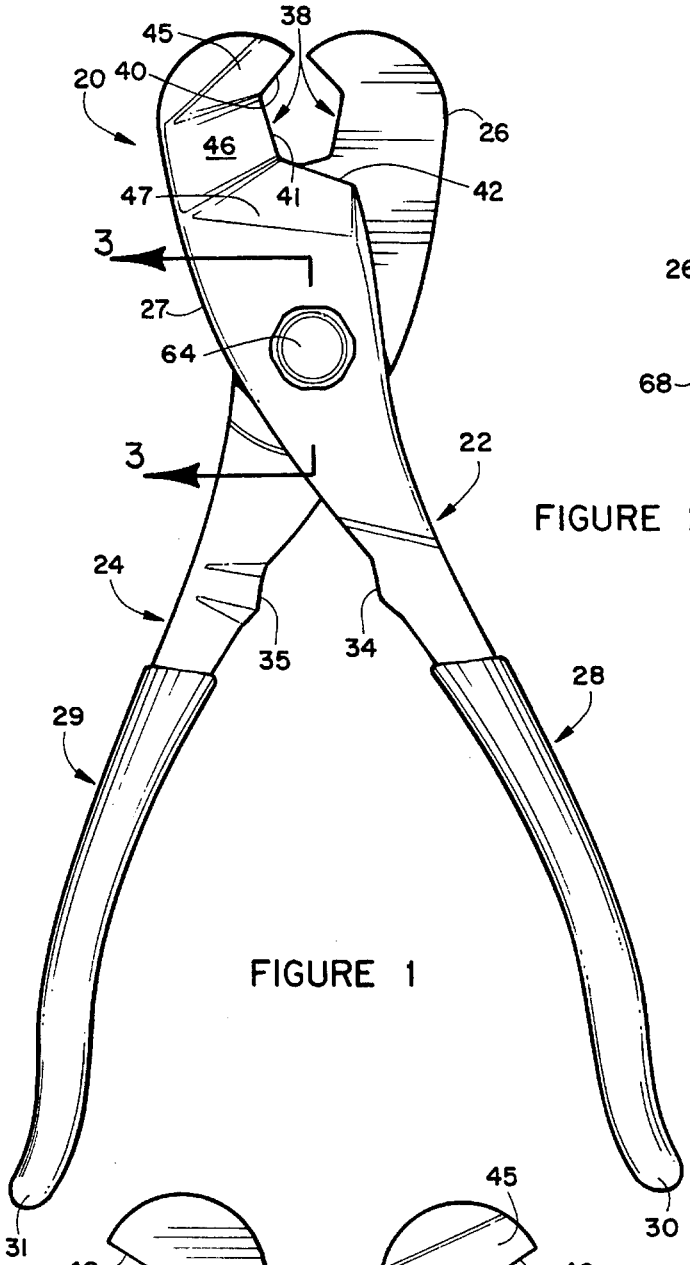
FIG. 1 is a front elevation view of the novel cutting tool.
Figure 2:
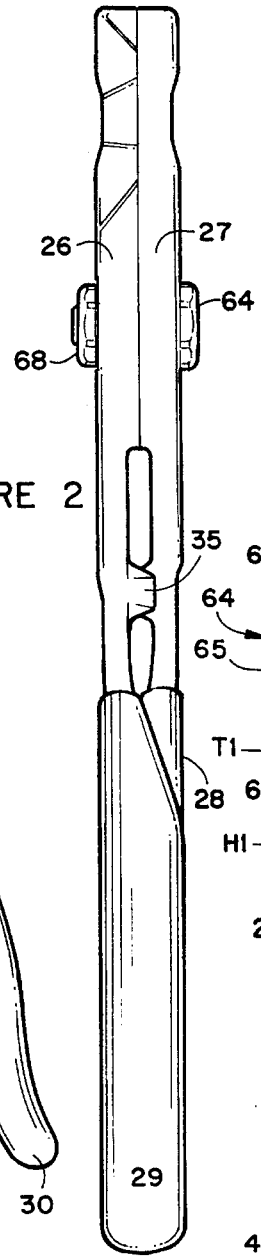
FIG. 2 is a left side elevation view of the novel cutting tool.
Figure 3:
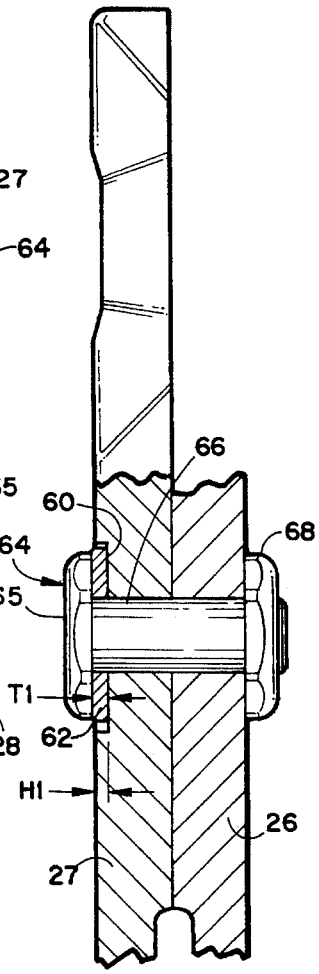
FIG. 3 is a cross sectional view taken along lines 3—3 of FIG. 1.
Figure 4:
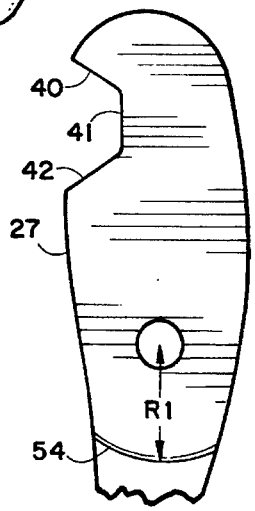
FIG. 4 is a rear elevation view of the head portion of the hinged elongated member.
Figure 5:
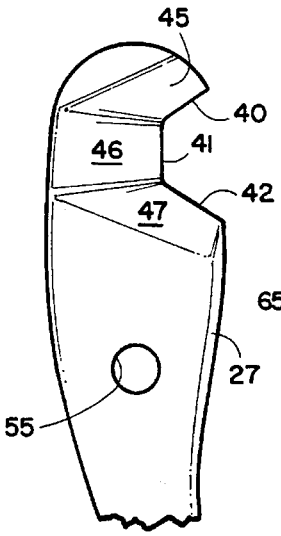
FIG. 5 is a front elevation view of the head portion of the hinged elongated member.
Figure 7:
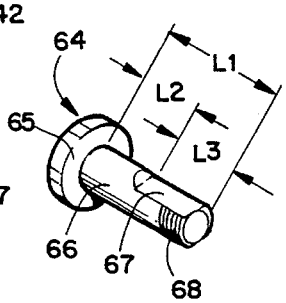
FIG. 7 is a front perspective view of the bolt.
Figure 6:
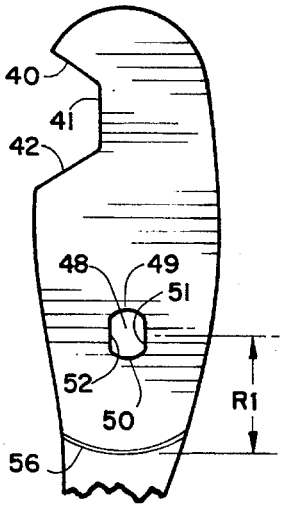
FIG. 6 is a rear elevation view of the head portion of the fixed or captured elongated member.

The novel cutting tool will now be described by referring to FIGS. 1–7 of the drawings. The cable cutting tool is generally designated numeral 20. Cable Cutting tool 20 has a pair of cooperating elongated members 22 and 24 having respective hinged head portion 27 and fixed or captured head portion 26. Elongated members 22 and 24 are pivotally secured together at an x-axis passing perpendicularly through the head portions. Elongated members 22 and 24 also have respective handle portions 28 and 29.

Handle portions 28 and 29 each have a convex outer surface curvature that mates with the person's hand that is gripping the tool. The convex outer surface curvature of the handle portions mate with the palm of a person's hand. This results in a pressure force being applied sooner to the cutting edges enabling an earlier more precise, clean cut. Reverse curvature tips 30 and 31 prevent the handles from slipping out of the palm of a person's hand. Pivot stops 34 and 35 limit the travel of the handle portions 28 and 29 toward each other.

Each of the head portions 26 and 27 have a cutting surface 38. Cutting surfaces 38 have a front edge portion 40, a central edge portion 41 and a rear edge portion 42. Front edge 40 intersects central edge portion 41 at an obtuse angle and central edge portion 41 intersects rear edge portion 42 at an obtuse angle. Each of these edge surfaces is substantially straight and when the respective head portions 26 and 27 are pivoted toward each other there are six substantially straight cutting surfaces that surround the entire cylindrical outer surface of a cable that is to be cut. Beveled surfaces 45, 46 and 47 extend downwardly from the top surface of the head portions to the respective edge portions of cutting surface 38. These beveled surfaces allow the outer peripheral portion of a cable as it is being cut to slide up these respective bevel surfaces and produces a nice clean cut without binding against the cutting surfaces.

Fixed head portion 26 has an aperture or bore hole 48 having two concave opposed portions 49 and 50 and two flat opposed portions 51 and 52. The rear end of head portion 27 has a radial curvature 54 having a radius R1. Hinged head portion 27 is substantially identical to head portion 26 except that it has a circular aperture 55 and it also has a radially configured curvature 54 whose radius is R1.

The front surface of head portion 27 has a countersunk recess 60 having a height H1 that is in the range of 0.015–0.030 inches. A brass washer 62 is positioned within recess 60 and it has a thickness T1 which is in the range of 0.015–0.030 inches. A bolt 64 having a head 65 and a shank 66 passes through the respective aligned apertures 48 and 55 and has a nut 68 threaded on its rear side. Shank 66 has a length L1. A portion of the shank has a length L2 and it is circular to mate with bore hole 55 in head portion 27.

Shank 66 also has a portion having a length L3 and it has two opposed convex sides and two opposed flat sides that mate with bore hole 48 of fixed head portion 26. Shank 66 has flat portions 67 and threaded convex portions 68 along length L3 that mate with apertures 48 and its flat sides 51, 52 and its concave surfaces 49, 50. Head 65 of bolt 64 has beveled surfaces as does nut 68 for eliminating sharp surfaces that can be snagged when the tool is removed from a pocket, pouch or belt.

Figure 8:
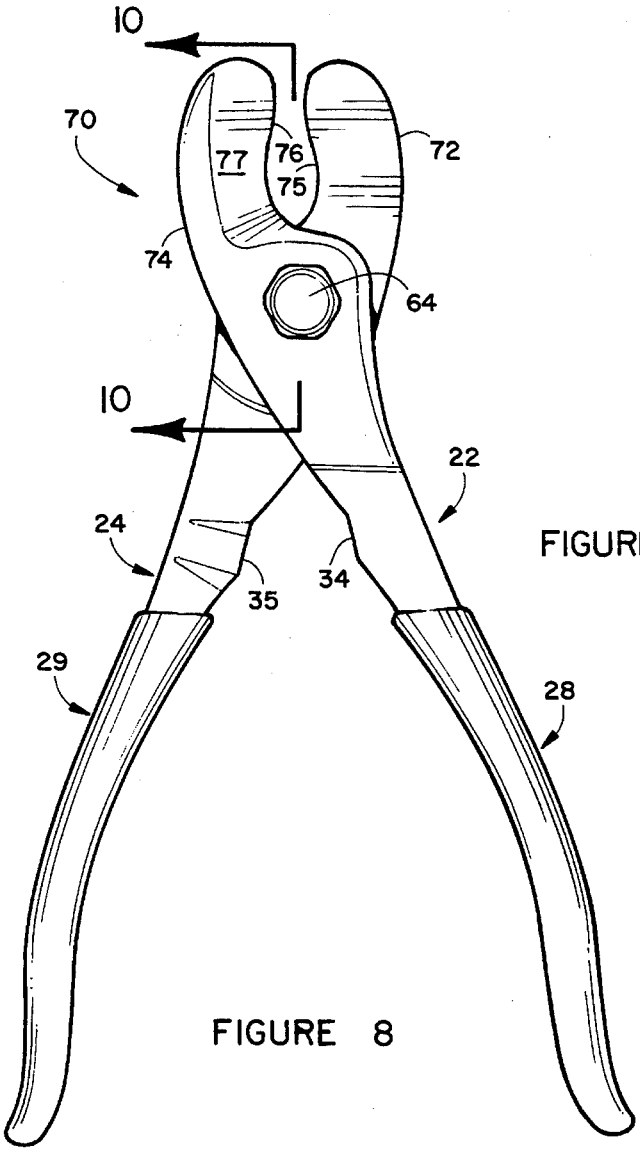
FIG. 8 is a front elevation view of an alternative embodiment of the novel cutting tool.
Figure 9:
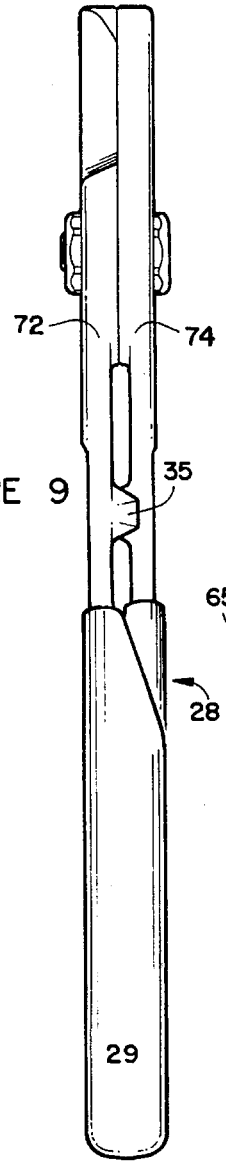
FIG. 9 is a left side elevation view of the alternative embodiment of the cutting tool.
Figure 10:
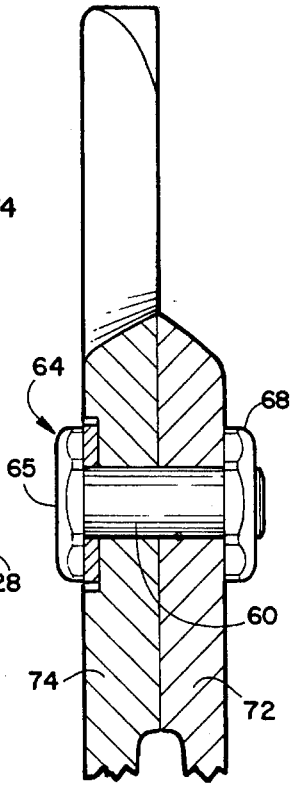
FIG. 10 is a cross sectional view taken along lines 10—10 of FIG. 8.
Figure 11:
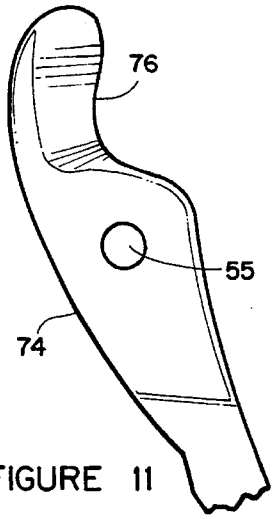
FIG. 11 is a front elevation view of the hinged head portion of the alternative embodiment cutting tool.
Figure 12:
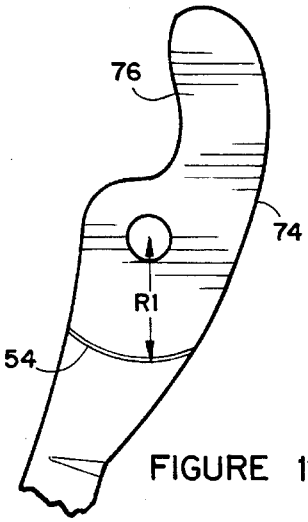
FIG. 12 is a rear elevation view of the head portion illustrated in FIG. 10.
Figure 13:
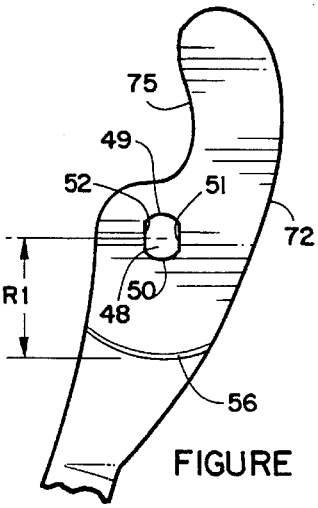
FIG. 13 is a rear elevation view of the fixed or captured head portion of the alternative embodiment cutting tool.

An alternative embodiment cutting tool 70 is illustrated in FIGS. 8–13. Much of its structure is similar and identical structure is designated by the same numerals as used to describe the cable cutting tool 20. The only difference is the shape of head portions 72 and 74 and in their respective cutting surfaces 75 and 76. These cutting surfaces are slightly curved and they have beveled surfaces 77 that slope down from the top surface of the respective head portions to their respective cutting surfaces.

What is claimed is:

1. A cable cutting tool comprising a pair of cooperating elongated members each having a handle portion and a head portion, said elongated members being pivotally secured together at a locus axis passing perpendicularly through said head portions; said handle portions each having an outer edge that has a convex curvature to comfortably fit in a person's hand and initiate the cutting action immediately upon gripping the respective handle portions;

said head portion each having a top surface, a bottom surface, a front end, a rear end, a left edge, a right edge having a cutting surface, and a bore hole passing from said top surface to said bottom surface; said right edge cutting surface having a substantially straight front edge portion, a substantially straight central edge portion and a substantially straight rear edge portion; said front edge portion (intersects) intersecting said central edge portion at an obtuse angle and said central edge portion intersecting said rear edge portion at an obtuse angle so that when said respective head portions are pivoted toward each other there are six substantially straight cutting surfaces that will surround the entire cylindrical outer surface of a cable that is to be cut; individual beveled surfaces extend downwardly from the top surface of said head portion to the respective front edge portion, the central edge portion and the rear edge portion of each said right edge cutting surface;

said head portions each having a rear end and a convex radius curvature where the head portions meet as the handle portions are squeezed together;

the respective bottom surfaces of said head portions mate with each other so that their respective cutting surfaces can be pivoted toward each other to perform a cutting action;

(a) said top surface of one of said head portions having a countersunk recess in its bore hole having a height, a brass ring having a thickness being received in said recess; the bore hole in said one of the head portions being circular and the bore hole in the other head portion having two concave opposed portions and two flat opposed portions; and a bolt passing through said brass ring and bore holes in said head portions and held in positions by a nut; said bolt having a shank and a portion of said shank having two opposed convex sides and two opposed flat sides that mate with the bore hole in said other head portion; said shank having a portion whose cross section is circular to mate with the bore hole in said one head portion.

2. A cable cutting tool as recited in claim 1 wherein said handle portions each has a rear end having a tip portion that has a reverse curvature to prevent the handle portion from slipping out of a person's hand.

3. A cable cutting tool as recited in claim 1 wherein said handle portions each has a pivot stop to limit how far the handle portions can be squeezed together.

4. A cutting tool as recited in claim 1 wherein the head of said bolt is beveled to eliminate its getting snagged on a tool pouch or support belt as it is being inserted or removed.

5. A cutting tool as recited in claim 4 wherein said nut has a top surface that is beveled to eliminate its getting caught on a tool pouch or support belt as it is being inserted or removed.

* * * * *